US005199367A

United States Patent [19]

Horiuchi et al.

[11] Patent Number: 5,199,367

[45] Date of Patent: Apr. 6, 1993

[54] CATAMARAN

[75] Inventors: Kotaro Horiuchi; Keiji Nakagawa; Fumitaka Yokoyama, all of Iwata, Japan

[73] Assignee: Yamaha Hatsudoki Kabushiki Kaisha, Iwata, Japan

[21] Appl. No.: 722,122

[22] Filed: Jun. 27, 1991

Related U.S. Application Data

[63] Continuation of Ser. No. 472,316, Jan. 30, 1990, abandoned.

[30] Foreign Application Priority Data

Jan. 31, 1989 [JP] Japan ..... 1-021979

[51] Int. Cl.[5] ..... B63B 1/00

[52] U.S. Cl. ..... 114/61

[58] Field of Search ..... 114/56, 61, 62, 283, 114/266, 267, 262, 352; D12/311-314

[56] References Cited

U.S. PATENT DOCUMENTS

| | | | |
|---|---|---|---|
| 1,822,418 | 9/1931 | Philip | 114/61 X |
| 2,996,030 | 8/1961 | Lornson | 114/61 X |
| 3,177,836 | 4/1965 | Salamin | 114/283 X |
| 3,345,967 | 10/1967 | Sweet | 114/61 |
| 3,807,337 | 4/1974 | English et al. | 114/56 |
| 3,996,869 | 12/1976 | Hadley | 114/61 X |
| 4,192,248 | 3/1980 | Moyer | 114/62 X |
| 4,348,972 | 9/1982 | Parsons | 114/61 |
| 4,348,977 | 9/1982 | Okajima | 114/61 X |
| 4,708,077 | 11/1987 | Balquet et al. | 114/61 X |
| 4,802,428 | 2/1989 | Lang | 114/61 |
| 4,907,520 | 3/1990 | Pipkorn | 114/61 |

FOREIGN PATENT DOCUMENTS 0291788 11/1988 Japan ..... 114/61

OTHER PUBLICATIONS

"Beyond 2001", P.C. Hercus, High-Speed Surface Craft Mar.-Apr. 1988, pp. 25-30.

International Catamaran Designs Pty Ltd Specification Sheet for Quicksilver V, dated Nov., 1988.

International Catamarans Specification Sheet for 2001 30 Metre Wave Piercing Catamaran, dated Aug., 1987.

*Primary Examiner*—Edwin L. Swinehart

*Attorney, Agent, or Firm*—Ernest A. Beutler

[57] ABSTRACT

Two embodiments of hull designs for catamarans in which the sponsons are configured so as to provide a displacement type operation and in which the sponsons are configured so as to improve stability while reducing flow resistance. The sponsons are generally curved along their bottom surfaces and have a width that begins at a knife edge, increases gradually toward midships, then decreases with an increasing width section at the rear end thereof. In one embodiment, the sponsons are asymmetric so as to reduce the generation of waves deflected inwardly toward the main hull. In another embodiment they are symmetric. The main hull is also provided with a step at its rear end so as to avoid wave interference and the sponsons have steps at their rear ends so as to reduce front end lift when travelling at high speeds and reduce flow resistance.

25 Claims, 4 Drawing Sheets

Figure 7
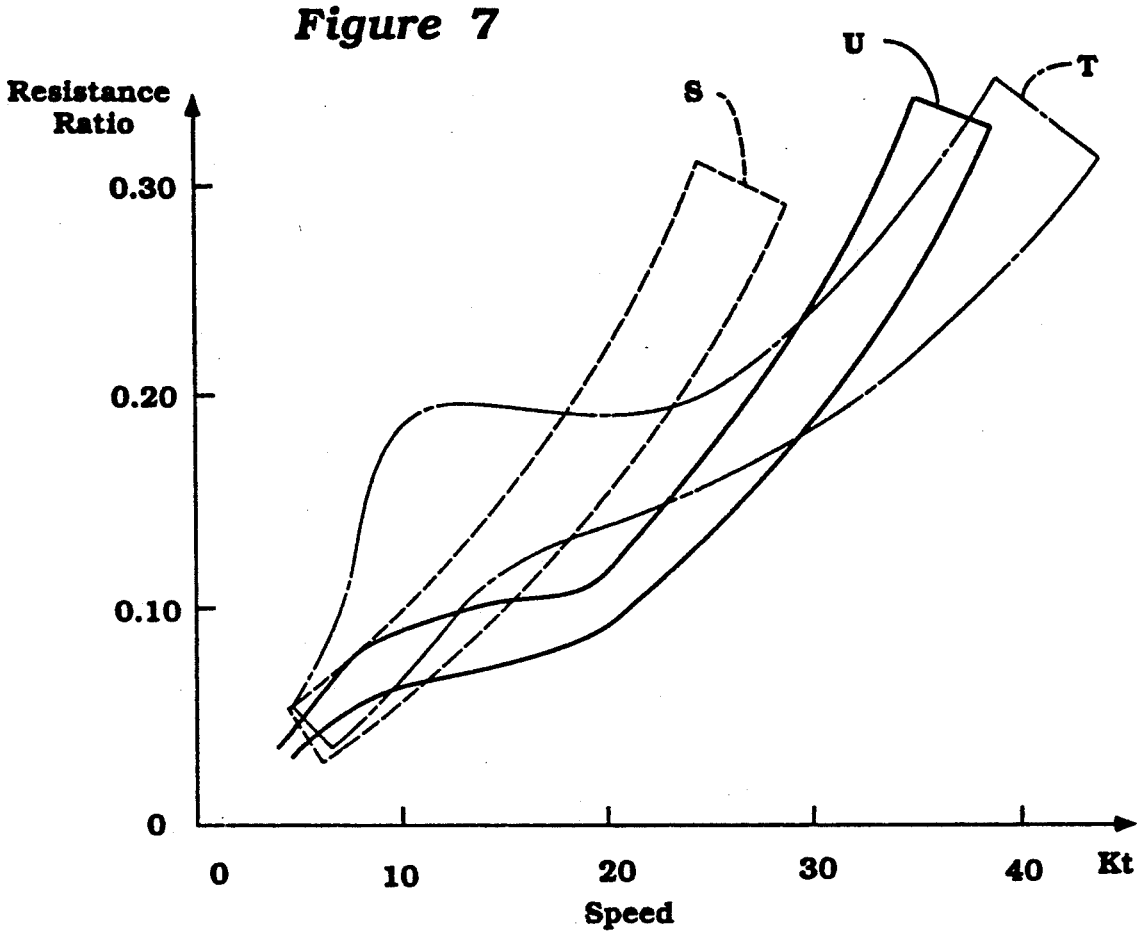
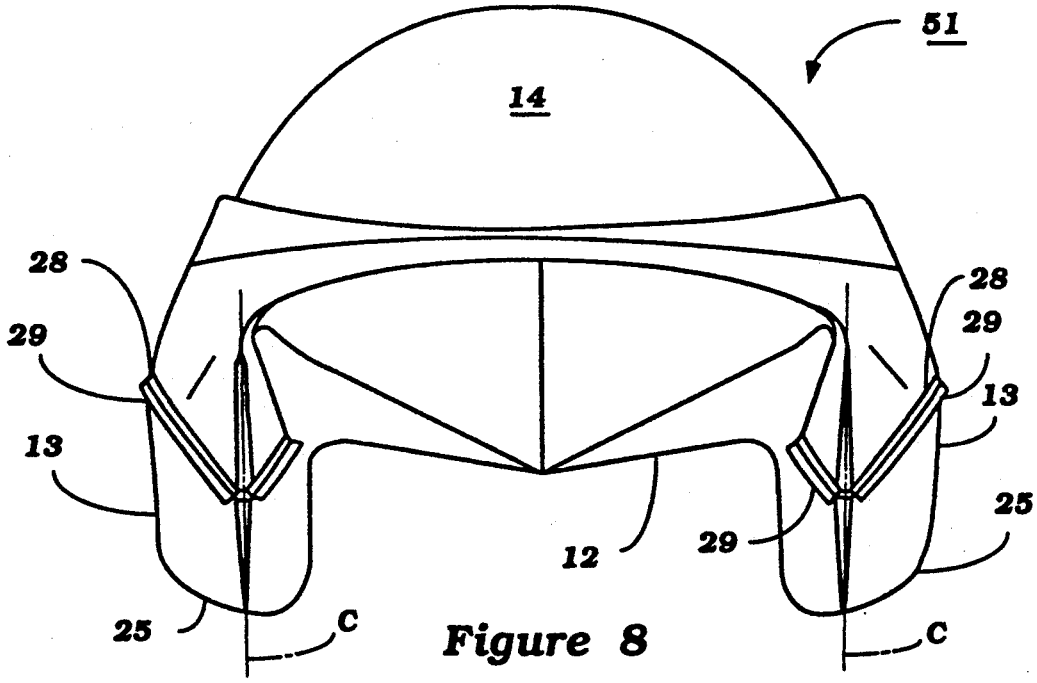
Figure 8

CATAMARAN

This is a continuation of U.S. patent application Ser. No. 472,316, filed Jan. 30, 1990 now abandoned.

BACKGROUND OF THE INVENTION

This invention relates to a catamaran and more particularly to an improved catamaran construction that permits high speed operation, good stability and ease of maneuverability.

The advantages of catamarans over conventional hulls are well known. Because of their relatively great length in relation to their width, a catamaran is able to travel at high speed and has excellent lateral stability. However, by its very nature, a planing type catamaran has the disadvantage that it is significantly affected by waves and is not always comfortable to drive. A displacement type hull, on the other hand, cannot run at high speeds even though it is stable because of the greater water resistance.

It is, therefore, a principal object of this invention to provide an improved catamaran that has the advantages of a catamaran and also the advantages of driving comfort and stability of a more conventional displacement hull.

It is a further object of this invention to provide an improved catamaran construction that will permit high speed operation and which will also be comfortable to drive and stable in all water conditions.

Frequently catamarans are configured with sponsons and also with a center hull to accommodate the passengers. However, it has been found that the conventional type of center hull has certain disadvantages. That is, as the sponsons cut through the water traveling at high speed, they generate a wave pattern that tends to act against the center hull and cause the watercraft to nose down in the water or to offer excess resistance to forward travel.

It is, therefore, a still further object of this invention to provide an improved hull configuration for a catamaran wherein a central hull will not adversely affect the wave pattern or operation of the watercraft under high speed operation.

The design of the sponsons is also quite important to the operation of the watercraft. That is, the sponsons should be designed so as to have low water resistance but they should also permit the watercraft to be turned over relatively small turning circles. Conventionally, a catamaran has good stability when travelling in straight line, but is difficult to achieve sharp turns.

It is, therefore, a still further object of this invention to provide an improved sponson design for a catamaran that permits the watercraft to travel at high speeds with low water resistance and yet make relatively small radius turns.

Another problem or consideration with sponson design is the fact that as the speed of the watercraft increases, the front of the sponson tends to rise up and can cause some instability of the watercraft. In addition, this tends to cause the rear of the sponson to become more deeply submerged and can add to the resistance and inability to travel at high speeds.

It is, therefore, a still further object of this invention to provide an improved sponson design for a catamaran wherein high speeds are permitted and wherein the attitude of the watercraft will not significantly change as the speed increases.

When the sponsons are of the displacement type, it has been found that the nose of the sponson will enter into waves when travelling under less than calm conditions. It is desirable to configure the front of the sponsons so that they can readily cut into the waves, yet so that the water will clear them easily when the wave has past. It is, therefore, a still further object of this invention to provide an improved sponson configuration that improves its ability to handle waves.

SUMMARY OF THE INVENTION

All of the features of the invention are adapted to be embodied in a catamaran construction that is comprised of a main hull and a pair of sponsons that are each supported at respective sides of the main hull. In accordance with a first feature of the invention, the sponsons have a cross sectional configuration below that normal water line in planes taken at transverse cross sections along the length that begin generally at a knife edge and which increase in width from the front toward amidships to a maximum and then reduce in width toward the rear of the sponsons. There is a further increase in width as these cross sections approach the rear end of the sponsons.

In accordance with another feature of the invention, the sponsons are configured so as to have a curved bottom section along their length.

In accordance with yet another feature of the invention, the sponsons are configured with gunnels that run along their length and which generally curve upwardly from the front to the rear and spray rails extend along these gunnels.

In accordance with another feature of the invention, the main hull is provided with a relief at its rear end so that the waves deflected by the rear portions of the sponsons will not be deflected back by the hull to produce interference.

BRIEF DESCRIPTION OF THE DRAWINGS

FIG. 7 is a graphic view showing the relative running speed and resistance ratio for a catamaran constructed in accordance with this invention (solid curve U) to a displacement type vessel with a round bottom (broken curve S) and a planing V type hull (dot-dash curve T).

FIG. 8 is a front elevational view, in part similar to FIG. 2, and shows another embodiment of the invention.

DETAILED DESCRIPTION OF THE PREFERRED EMBODIMENTS OF THE INVENTION

Figure 1:
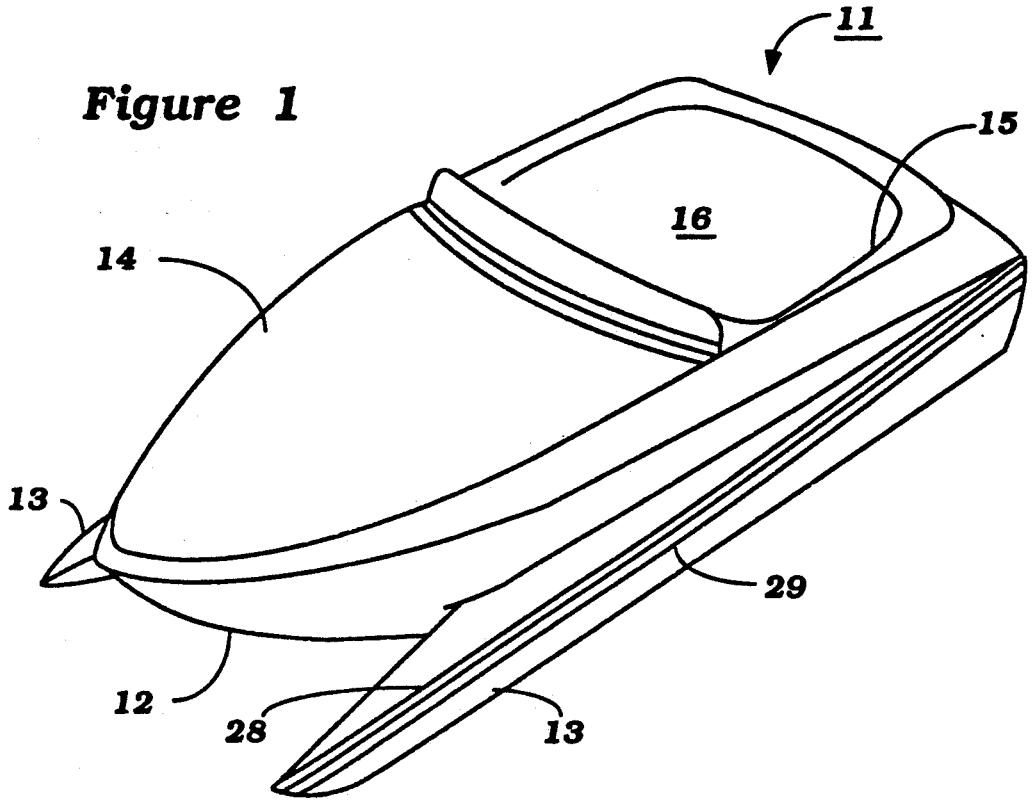
FIG. 1 is a perspective view of a catamaran constructed in accordance with an embodiment of the invention taken from above, the front and one side.
Figure 2:
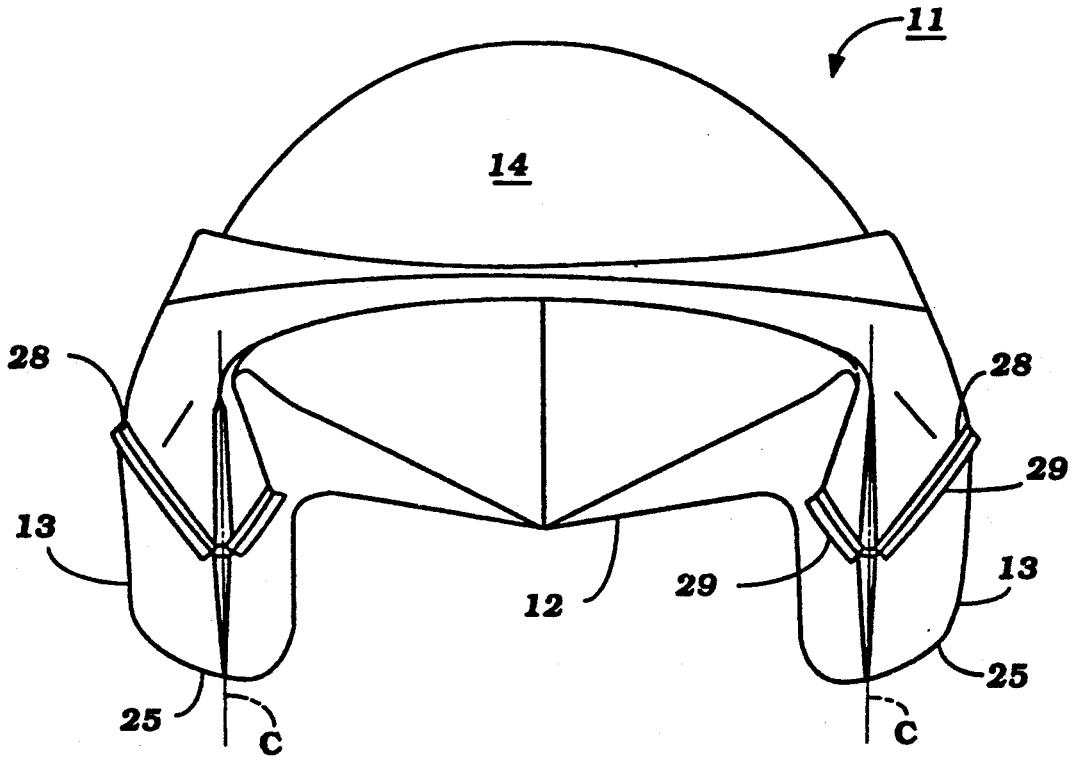
FIG. 2 is an enlarged front elevational view thereof.
Figure 3:
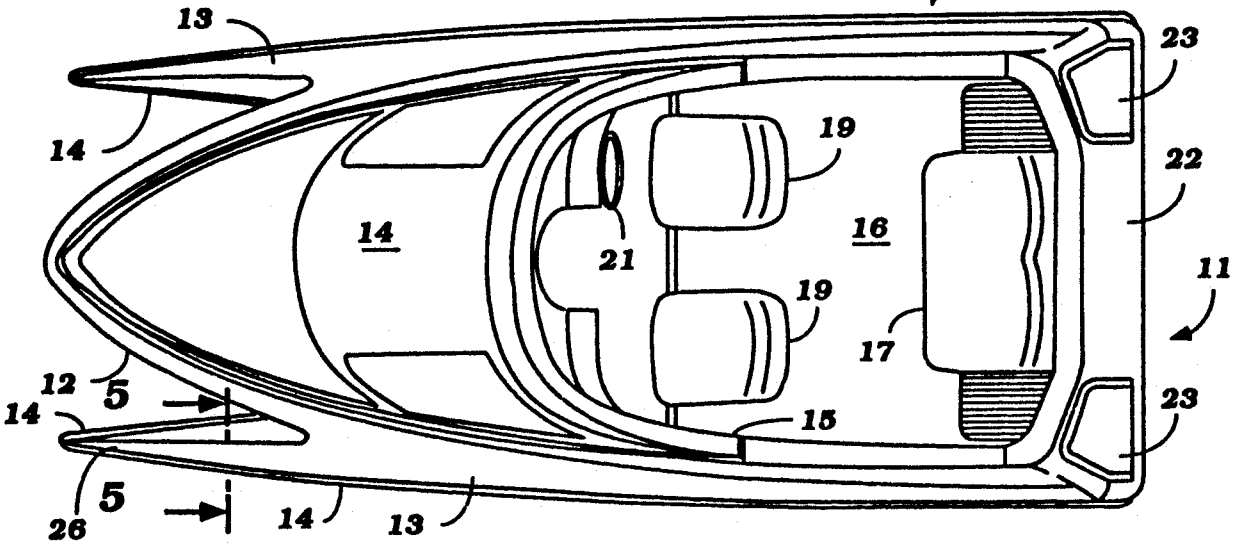
FIG. 3 is an enlarged top plan view thereof.
Figure 4:
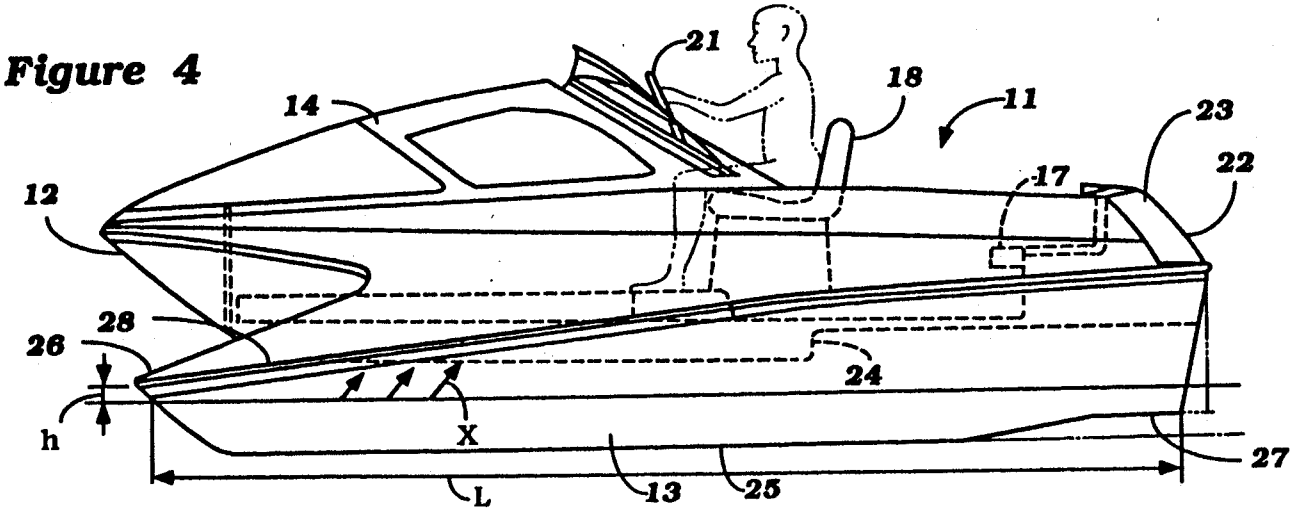
FIG. 4 is an enlarged side elevational view thereof.

Referring in detail to the drawings and initially to FIGS. 1 through 4, a catamaran constructed in accordance with an embodiment of the invention is identified generally by the reference numeral 11. The catamaran 11 is comprised of a hull assembly that is formed from a suitable material such as a molded fiberglass reinforced resin and consists of a main hull 12 and a pair of sponsons 13 that are affixed to and extend outwardly from the respective sides of the main hull 12. The main hull has a forward deck portion 14 which may form a forward cockpit or cabin. An opening 15 formed in the rear of the deck 14 defines an open passenger compartment 16 having a dual rear seat 17, an operator's seat 18 and a forward passenger seat 19. Of course, other seating arrangements may be provided. A control panel and steering wheel 21 is positioned in front of the driver's seat 18 for operating the watercraft.

A transom 22 is formed at the rear of the rider's compartment 16 and defines a pair of wells 23 that are adapted to mount outboard motors (not shown). Of course, it should be understood that other forms of propulsion devices including inboard or inboard/outboard propulsion units may be employed for the watercraft 11. The choice of the V bottom for the main hull 12 is made so as to insure ease of penetrating waves and good performance. That is, the V bottom of the main hull 12 will readily cut any waves which it may encounter regardless of the running speed. However, at the rear of the main hull 12 there is provided a flat step 24 (FIG. 4) that extends a substantial distance above the main portion of the main hull and in the area toward the rear of the sponsons 13. Without this step, the waves displaced by the sponsons 13 might strike the sides of the main hull and interfere with the wave pattern from the sponsons and also cause instability. Furthermore, this step 24 permits the weight of the main hull to be reduced.

Referring now primarily to FIGS. 2, 4, 5 and 6, the configuration of the sponsons 13 will be described. As may be best seen in FIGS. 2 and 5, the sponsons 13, which have their leading edges slightly to the rear of the bow of the main hull 12, have generally curved lower surfaces 25 which, in accordance with a feature of this embodiment of the invention, are asymmetric relative to a vertically extending center plane C passing through the sponsons. That is, the inboard sides of the sponsons and specifically their curved lower portions 25 are steeper than the outer portions. As a result, there will be a greater wave pattern generated away from the main hull 12 than toward it. This will further reduce the turbulence caused by the operation of the watercraft through the body of water. In addition, this will reduce the trailing waves coming off of the sponsons toward the main hull and also will make turning on a small radius much easier because the steeper sides of the inner portions of the sponsons 13 will trap water. Also, this configuration will tend to reduce the leaning of the hull when making turns. The curved shape also reduces the contact area and wave drag but provides sufficient buoyancy so as to lift the main hull 12 out of the water, hence the sponsons are in effect displacement hulls.

Figure 6:
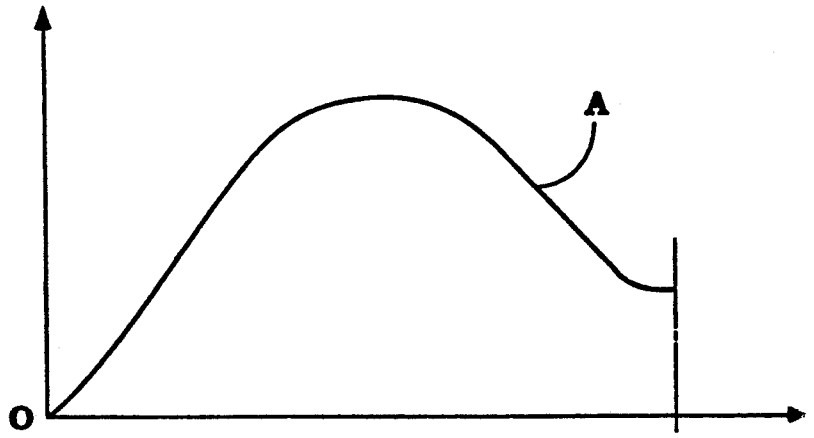
FIG. 6 is a graphic view showing the cross sectional area A of the sponsons in planes taken perpendicular to the longitudinal axis thereof along their length.

It should also be noted that the sponsons 13 have a cross sectional configuration taken in planes perpendicular to their longitudinal center line which starts out at the forward end at a knife edge 26 and which gradually increases in width and cross section moving toward midships as shown in FIG. 6. FIG. 6 is a curve showing the cross sectional area A of the sponson below the water line at rest in these cross sections from the front 0 to the rear or transom T. It will be seen that the shape increases up until the midsection of the main hull and then gradually decreases with an increase at the end. This displacement configuration is effective in providing good performance.

It should be noted that the rear portions of the sponsons are provided with a step, as at 27, which tends to reduce the lift at the rear of the sponson and will insure that the watercraft will operate at a good orientation and also will reduce drag. Water striking the rear of the step 27 will tend to maintain a more level ride and will also reduce drag caused by float up of the bow portions. Thus, the resistance to high speed travel is substantially reduced.

It should be noted that there are gunnels 28 running along the length of the sponsons 13 and at their forward end, these gunnels are at a height H that is relatively low relative to the water line, specifically approximately 5% less than the length L of sponsons so that the front ends will easily plow into waves and improve stability. However, the curved shape of the top of the sponsons 13 effectively permits the waves that do impact upon the top of the sponsons 13 to flow back and be discharged. It should be seen that the gunnels 28 generally progress upwardly toward the rear of the watercraft. This will cause the waves to follow the line X as shown and provide a good, smooth operation.

Figure 5:
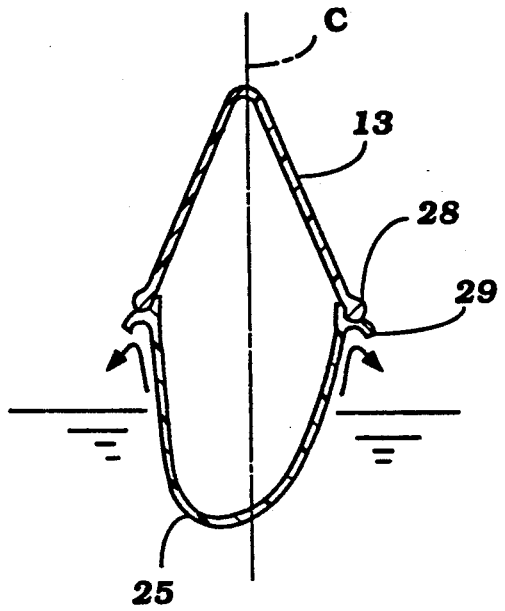
FIG. 5 is a cross sectional view taken along the line 5—5 of FIG. 3 and shows the cross section of one of the sponsons.

To further improve performance and avoid splashing, there are provided wave deflector strips 29 that extend along the length of the gunnels 28 and which will redirect the water flow as shown in FIG. 5 so as to avoid splashing. The operation of the wave strips 29 also reduces the operation of the pressure of the waves acting on the hull.

FIG. 7 shows the relationship between running speed and resistance ratio (resistance - total weight) for a catamaran according to this invention (solid line curve U), a conventional displacement type vessel with a round bottom (broken line curve S) and a planing type vessel with a V shaped hull (dot-dash line T). All vessels have an eight meter length and four tons total weight. It will be seen that the resistance ratio of the catamaran according to this invention is as small as the displacement type vehicle in the low speed range and not significantly greater than the planing type vessel at the high speed range. As a result, the performance of this vessel incorporates the best features of the designs of both conventional type vessels.

In the embodiment of the invention as thus far described, the sponsons have been asymmetric in cross section. The invention can be utilized, however, in conjunction with watercraft wherein the sponsons are symmetrical and FIG. 8 shows such an embodiment. Because of the similarity of this embodiment to the previously described embodiment, corresponding reference numerals have been employed for providing corresponding parts, although the vessel is identified generally by the reference numeral 51, and further description is believed to be unnecessary.

From the foregoing description it should be readily apparent that the catamaran designs disclosed are highly effective in providing good performance as well as easy operation and good drivability. It is to be understood, however, that these descriptions are those of preferred embodiments of the invention and that various changes and modifications may be made without departing from the spirit and scope of the invention, as defined by the appended claims.

We claim:

1. A catamaran comprised of a main hull having a V bottom defined by a pair of downwardly converging sides and a pair of sponsons each supported at a respective side of said main hull merging into the respective side thereof from forwardly extending tops spaced transversely outwardly from said respective sides and having upper portions extending above the bottom of said main hull, the top sand inner sides of said sponsons each merging into the respective side of said main hull above the bottom of said hull, said sponsons having cross sectional areas in planes taken at transverse cross sections along the length and below the water line that begin generally at a knife edge and which increase in a stepless fashion in cross sectional area from the front toward amidships to a maximum and then reduce in a stepless fashion in cross sectional area toward the rear of the sponsons and then increase in a stepless fashion in cross sectional area toward the end thereof.

2. A catamaran as set forth in claim 1 wherein the sponsons have a curved bottom.

3. A catamaran as set forth in claim 2 wherein the sponsons are asymmetric about a longitudinally extending plane.

4. A catamaran as set forth in claim 3 wherein the sponsons are deeper below the water line on the sides adjacent the main hull and taper upwardly away from the main hull so as to minimize the waves generated toward the main hull.

5. A catamaran as set forth in claim 3 wherein the sponsons are formed with a step at their rear ends.

6. A catamaran as set forth in claim 5 wherein the sponsons are deeper below the water line on the sides adjacent the main hull and taper upwardly away from the main hull so as to minimize the waves generated toward the main hull.

7. A catamaran as set forth in claim 2 wherein the sponsons are symmetric about a longitudinally extending center plane.

8. A catamaran as set forth in claim 7 wherein the sponsons are formed with a step at their rear ends.

9. A catamaran as set forth in claim 1 wherein the sponsons are provided with gunnels running from their front to their rear ends.

10. A catamaran as set forth in claim 1 wherein the main hull has a V configuration.

11. A catamaran as set forth in claim 10 wherein the main hull has a step at the rear end thereof so as to avoid interference with waves deflected inwardly by the sponsons toward the main hull.

12. A catamaran comprised of a main hull having a V bottom defined by a pair of downwardly converging sides and a pair of sponsons each supported at a respective side of said main hull and having upper portions extending above the bottom of said main hull and merging into the respective side of said main hull above the bottom of said hull, said sponsons having a cross sectional configurations in planes taken at transverse cross sections along the length and below the water line that begin generally at a knife edge and which increase in width cross sectional area from the front toward amidships to a maximum and then reduce in width cross sectional area toward the rear of the sponsons and then increase in width cross sectional area again toward the end thereof, said sponsons being formed with gunnels running from their front to the rear ends, said gunnels extending from a point slightly above the water line at their bow end and gradually increasing above the water line toward their stern ends.

13. A catamaran as set forth in claim 12 further including a spray rail extending along the sponsons adjacent the gunnels for directing waves downwardly.

14. A catamaran as set forth in claim 13 wherein the sponsons have a curved bottom.

15. A catamaran as set forth in claim 14 wherein the sponsons are asymmetric about a longitudinally extending plane.

16. A catamaran as set forth in claim 15 wherein the sponsons are deeper below the water line on the sides adjacent the main hull and taper upwardly away from the main hull so as to minimize the waves generated toward the main hull.

17. A catamaran as set forth in claim 15 wherein the sponsons are formed with a step at their rear ends.

18. A catamaran as set forth in claim 17 wherein the sponsons are deeper below the water line on the sides adjacent the main hull and taper upwardly away from the main hull so as to minimize the waves generated toward the main hull.

19. A catamaran as set forth in claim 13 wherein the sponsons are symmetric about a longitudinally extending center plane.

20. A catamaran as set forth in claim 19 wherein the sponsons are formed with a step at their rear ends.

21. A catamaran comprised of a main hull having a V bottom defined by a pair of downwardly converging sides defining in substantial part a rider's area and a pair of sponsons each supported at a respective side of said main hull and having upper portions extending above the bottom of said main hull and merging into the respective side of said main hull above the bottom of said hull, said sponsons having parallel vertical sides connected at their lower ends by a curved lower surface taken in transverse cross sections along its length, said sponsons being asymmetric about a longitudinally extending plane passing through said sponsons midway between said vertical sides, said sponsons being deeper below the water line on the sides adjacent said main hull and taper upwardly away from said main hull so as to minimize the waves generated toward the main hull.

22. A catamaran as set forth in claim 21 wherein the sponsons are formed with a step at their rear ends.

23. A catamaran as set forth in claim 21 wherein the sponsons are provided with gunnels running from their front to their rear ends.

24. A catamaran as set forth in claim 23 wherein the gunnels extend from a point slightly above the water line at their front end and gradually and continuously increase above the water line toward their rear ends.

25. A catamaran as set forth in claim 24 further including a spray rail extending along the sponsons adjacent the gunnels for directing waves downwardly.

* * * * *